US005457360A

United States Patent [19]

Notohamiprodjo et al.

[11] Patent Number: 5,457,360

[45] Date of Patent: Oct. 10, 1995

[54] DIMMING CIRCUIT FOR POWERING GAS DISCHARGE LAMPS

[75] Inventors: Hubie Notohamiprodjo, Vernon Hills; John M. Wong, Buffalo Grove; Dennis L. Stephens, Niles, all of Ill.

[73] Assignee: Motorola, Inc., Schaumburg, Ill.

[21] Appl. No.: 209,323

[22] Filed: Mar. 10, 1994

[51] Int. Cl.[6] ..... H05B 37/00

[52] U.S. Cl. ..... 315/219; 315/291; 315/DIG. 4

[58] Field of Search ..... 315/291, 307, 315/DIG. 5, DIG. 7, 224, 219, 244, 209 R, DIG. 4

[56] References Cited

U.S. PATENT DOCUMENTS 4,240,009 12/1980 Paul ..... 315/224
4,251,752 2/1981 Stolz ..... 315/206
4,700,113 10/1987 Stupp et al. ..... 315/224
5,003,230 3/1991 Wong et al. ..... 315/279
5,089,751 2/1992 Wong et al. ..... 315/279

*Primary Examiner*—Robert J. Pascal
*Assistant Examiner*—David Vu
*Attorney, Agent, or Firm*—J. Ray Wood

[57] ABSTRACT

A ballast circuit uses an optocoupler to provide electrical isolation of the dimming control from the remainder of the ballast. The optocoupler is operated in the linear range to provide continuous dimming of the lamps. The circuit further uses a combination of diodes and a diode bridge to steer current from the current sensor during lamp out conditions so that the inverter will maintain operation at a low frequency, thereby maximizing the output voltage. A clamp winding is used to insure that the voltage does not exceed the DC rail voltage.

13 Claims, 2 Drawing Sheets

DIMMING CIRCUIT FOR POWERING GAS DISCHARGE LAMPS

Inverter circuits are used to power fluorescent lamps. Generally, AC (alternating current) power at a first frequency (usually around 60 Hz [hertz]) is converted into DC (direct current) power. The inverter then converts the DC into AC power at a second higher frequency (usually around 24 KHz [kilohertz]). Because the lamps are more efficient at the second higher frequency, significant energy savings are achieved.

In order to further maximize the energy savings, circuits for powering gas discharge lamps may provide a variable power output. With such a variable power output, the lamps may be dimmed or brightened.

One way to dim lamps in ballast circuits with inverters is to vary the frequency of the output of the inverter. The lamps are coupled to the inverter by way of a series resonant circuit. As the frequency of the output of the inverter changes, the amount of power supplied to the lamps also changes, thus affecting a change in the luminescence of the lamps. In order to actuate dimming, a control is used to change the brightness of the lamps. It is highly desirable that the control be electrically isolated from the remainder of the ballast circuit.

One significant problem with dimming ballasts occurs during "lamp out" conditions. Often, lamps are removed while the ballast is energized. When the lamps are reinserted into the circuit, the circuit must "strike" the lamps. As is well known, a high voltage must be applied to strike the fluorescent lamps. In dimming circuits, the problem of striking the lamps is complicated because the brightness of the lamps may be at a level other than maximum brightness. If the lamps are at a low brightness, there may be insufficient voltage at the output of the ballast to strike the lamps.

In case the lamps are removed from the circuit while the circuit is energized, the circuit also must be protected from high voltages which may result in failure of circuit components.

It is therefore highly desirable to have a dimming circuit that will strike the lamps, regardless of the brightness level of the lamps, when the lamps are reinserted following a lamp-out condition. The circuit should also have protection from high voltages during lamp-out conditions and provide electrical isolation of the dimming control from the remainder of the ballast circuit.

DESCRIPTION OF THE PREFERRED EMBODIMENT

In order to accomplish the aforementioned goals, the ballast circuit uses an optocoupler to provide electrical isolation of the dimming control from the remainder of the ballast. The optocoupler is operated in the linear range to provide continuous dimming of the lamps. The circuit further uses a combination of diodes and a diode bridge to steer current from the current sensor during lamp out conditions so that the inverter will maintain operation at a low frequency, thereby maximizing the output voltage. A clamp winding is used to insure that the voltage does not exceed the DC rail voltage.

Figure 1:
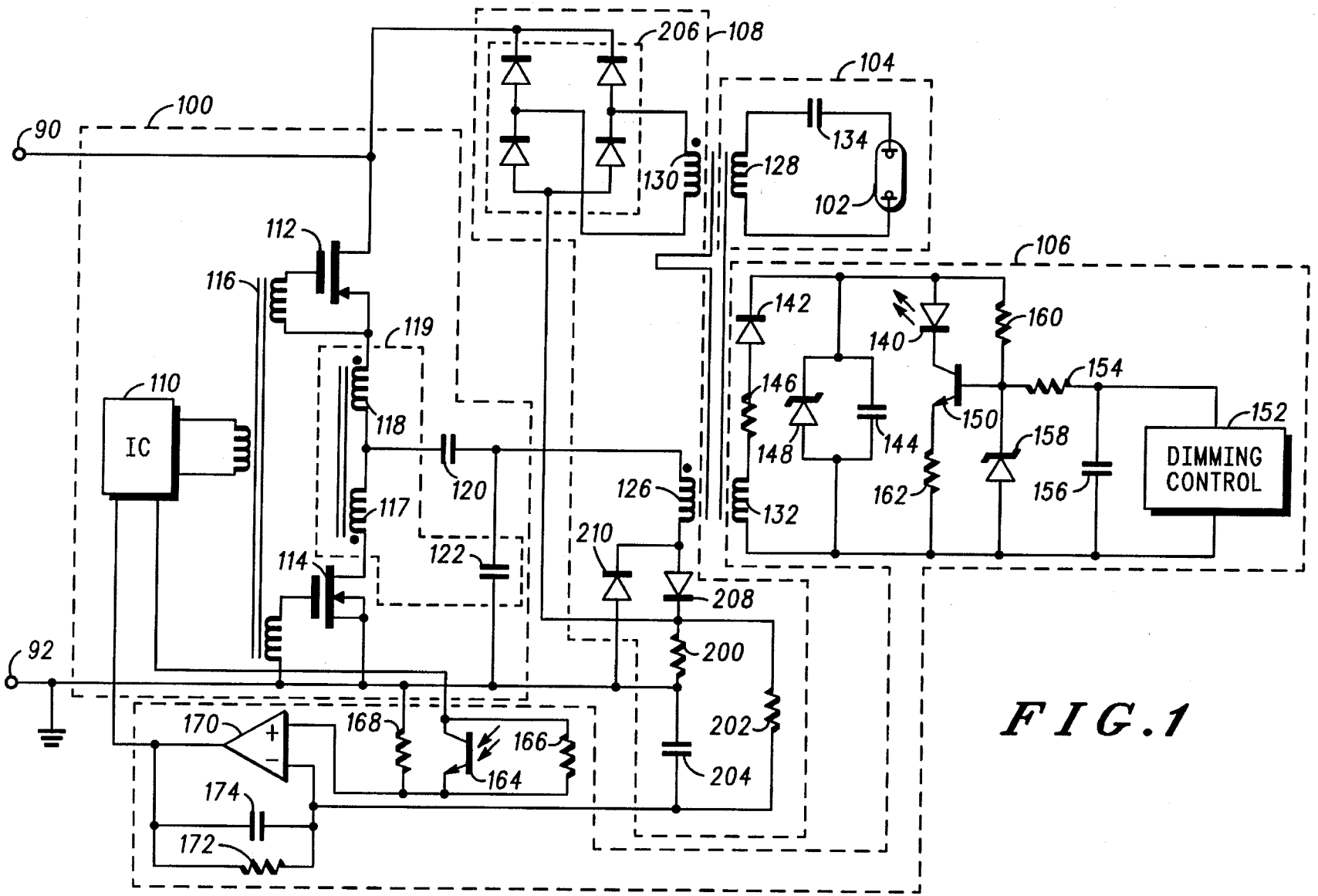
FIG. 1 is a ballast circuit having a dimming capability.

A circuit for driving a gas discharge lamp is shown in FIG. 1. Terminals 90, 92 are coupled to a source of DC power. Terminal 90, coupled to the anode of the DC power, is referred to as the upper rail, while terminal 92, coupled to the cathode of the DC power, is referred to as the lower rail. The DC voltage is referred to as the "rail voltage".

Terminals 90, 92 are also the input for inverter 100. Inverter 100 converts the DC voltage into AC voltage at the inverter frequency. Inverter 100 drives lamps 102 via output circuit 104. Dimming interface control 106 provides the analog controls for the power supplied to lamps 102. Lamp current sensing circuit 108 samples the current through lamps 102 and provides feedback to dimming interface control 106.

Inverter 100 is driven by inverter control integrated circuit (IC) 110. IC 110 alternately drives transistors 112, 114. (FIG. 1 shows two field effect transistors. Other semiconductor switches could be used.) Transformer 116 couples the control IC 110 to transistors 112, 114. Transformer 116 provides isolation from ground for transistor 112.

Resonant circuit 119 has a pair of coupled resonant inductors 117, 118 connected between the source of transistor 112 and the drain of transistor 114. Capacitor 120 provides AC coupling and DC blocking for inverter 100. Resonant capacitor 122 resonates at a resonant frequency with either resonant inductor 117 or resonant inductor 118, depending on which of transistors 112, 114 is conducting.

The use of a pair of coupled resonant inductors provides several advantages. First, the leakage inductance between the two coupled resonant inductors 117, 118 limits the crossover currents if transistors 112, 114 are conducting simultaneously. Second, because the current in the resonant circuit is spread equally between the two coupled resonant inductors 117, 118, there is less loss and better heat dissipation. Finally, the resonant inductors 117, 118 can be moved to other locations in the circuit.

For example, resonant inductor 118 could be moved to the drain side of transistor 112. Alternatively, resonant inductor 117 could be moved to the source side of transistor 114.

If transistors 112, 114 were bipolar junction transistors (BJTs), both resonant inductors 117, 118 could be moved to opposite sides of transistors 112, 114. In this configuration, resonant inductors 117, 118 would increase the switching speed of transistors 112, 114.

The output of the inverter is the voltage across resonant capacitor 122. The output of the inverter 100 is coupled to the lamps 102 by way of transformer 124. Transformer 124 has primary winding 126, secondary winding 128, clamp winding 130, and auxiliary dimming voltage winding 132. Secondary winding 128 drives lamps 102 through anti-rectification capacitor 134.

Anti-rectification capacitor 134 blocks the effect of the diode operation of the lamps 102. As lamps 102 near their end of life, they operate like a diode. Anti-rectification capacitor 134 blocks the DC voltage from the lamps 102 so that there is no effect on the operation of the ballast.

Dimming interface control 106 controls the dimming of the lamps 102 by controlling the power supplied by inverter 100 to lamps 102. Auxiliary dimming voltage winding 132 provides a voltage to power optocoupler light emitting diode (LED) 140. Diode 142 and capacitor 144 rectifies the AC voltage from dimming voltage winding 132. Resistor 146 limits the current for optocoupler LED 140. Zener diode 148 limits the maximum voltage for the optocoupler LED 140.

Transistor 150 operates as an amplifier to control the current through optocoupler LED 140. The base of transistor 150 is coupled to an analog dimming control 152. Resistor 154 limits the current to dimming control 152. Capacitor 156 suppresses the noise from the dimming control to the dimming interface control 106. Zener diode 158 protects the dimming control 152 by limiting the maximum voltage on the dimming control 152.

Figure 2:
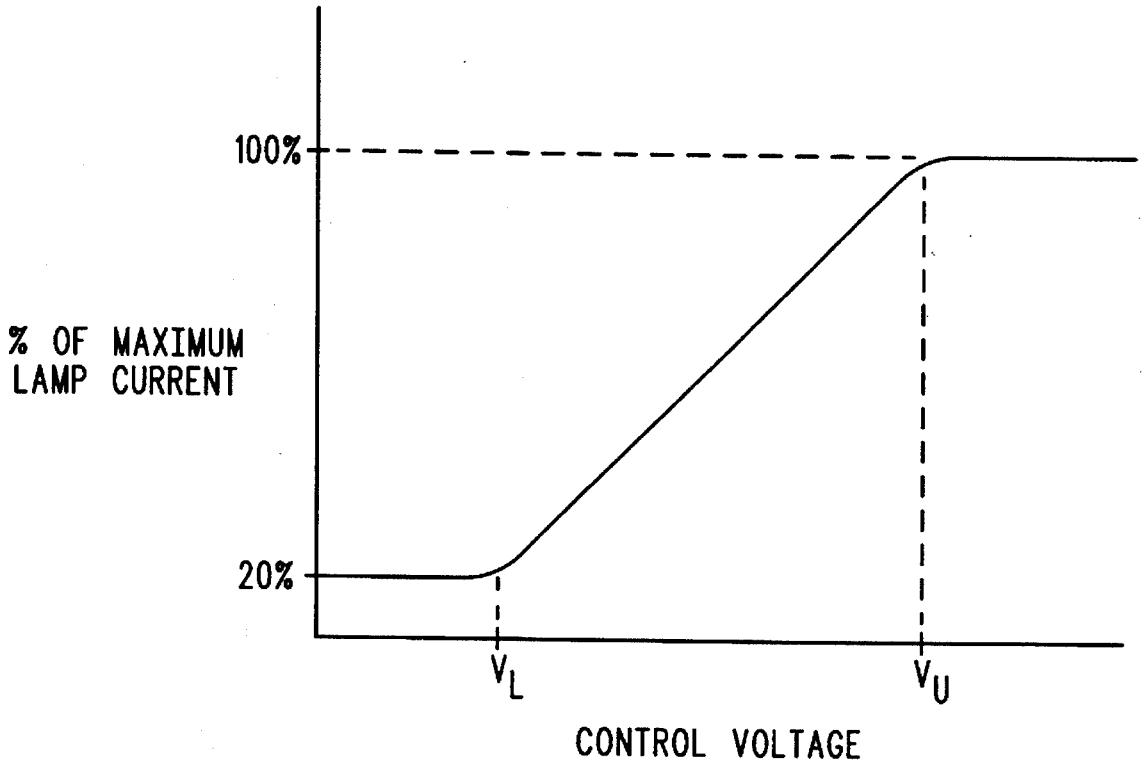
FIG. 2 is a graph of the dimming control voltage with the percentage of maximum lamp current of the ballast circuit of FIG. 1.

The operation of resistors 160, 162 can be shown by reference to FIG. 2. Dimming control voltage, shown on the X-axis of the graph in FIG. 2, is the voltage across dimming control 152. Percentage of maximum lamp current through lamps 102 is shown on the Y-axis of the graph of FIG. 2.

$V_u$ is the upper voltage threshold. $V_l$ is the lower voltage threshold. When the voltage across the dimming control is between $V_u$ and $V_l$, the current through the lamp may be changed by changing the voltage across the dimming control. When the voltage is between $V_u$ and $V_l$, the current through the lamp is directly proportional with the voltage across the dimming control. However, when the voltage across the dimming control is greater than $V_u$, the lamp current is at maximum. Similarly, then the voltage across the dimming control is less than $V_l$, the lamp current is at a minimum.

$V_u$ is established by the ratio of the resistance of resistor 160 to the resistance of resistor 162. Resistors 160, 162 bias transistor 150. The bias of resistors 160, 162 controls the amount of current through transistor 150.

Optocoupler LED 140 and photo transistor detector 164 provides isolation between dimming control 152 and the ballast. As current flows through optocoupler LED 140, light is emitted. The light is received by photo transistor detector 164. The amount of light received by photo transistor detector 164 controls the amount of current allowed to pass from the collector to the emitter of the photo transistor detector 164. Resistors 166, 168 form a voltage divider. The ratio between the resistance of resistor 166 and the resistance of resistor 168 establish $V_l$, as shown in FIG. 2.

The emitter of photo transistor detector 164 is coupled to the junction between resistors 166, 168 and to the positive input of operational amplifier 170. The negative input of operational amplifier circuit 170 is coupled to the output of the lamp current sensing circuit 108. Resistor 172 and capacitor 174 form a low pass compensation network. The compensation network makes the voltage output of the operational amplifier 170 track the voltage at the inputs of the operational amplifier 170. The output of operational amplifier 170 is coupled to control IC 110.

When the voltage at the positive input of operational amplifier 170 is greater than the voltage at the negative input, operational amplifier 170 produces a positive voltage at the output of the operational amplifier 170. In response to the voltage, the control IC 110 decreases the operating frequency of the inverter 100. As the frequency of the inverter 100 decreases, the current through lamps 102 increases until the voltage at the negative input to operational amplifier 170 is equal to the voltage at the positive input to the operational amplifier 170. The output of the operational amplifier 170 is also equal to the voltage at either of the inputs to the operational amplifier 170.

Lamp current sensing circuit 108 senses the current through lamps 102 and provides a voltage output to operational amplifier 170. Sense resistor 200 translates the current through the lamps 102 to a voltage. Resistor 202 and capacitor 204 forms a filter to the input of the operational amplifier 170.

Clamp winding 130 is positioned such that there is a high leakage to secondary winding 128 and to primary winding 126. The high leakage provides a non-distorted sinusoidal voltage for the primary winding 126 and secondary winding 128.

Clamp winding 130 is connected to the input of diode bridge 206. The cathode side of the diode bridge 206 is connected the positive input DC voltage. The anode of the diode bridge 206 is connected to the sense resistor 200. Sense resistor 200 acts as a sensor. The diode bridge 206 clamps the voltage across the clamp winding 130 so that the voltage does not exceed the input DC voltage. The turns ratio of clamp winding 130 to secondary winding 128 determines the open circuit (i.e., when the lamps are out) voltage of the ballast. Clamp winding 130 and diode bridge 206 form a clamp network for limiting the voltage to a clamp voltage during a fault condition.

Diode 208 is connected in series between the primary winding 126 and the sense resistor 200. Diode 210 is connected in parallel with series combination of resistor 200 and diode 208.

When lamps 102 are in place, the voltage on the clamp winding 130 is less than the DC rail voltage. Therefore, diode bridge 206 does not conduct. The current through primary winding 126 goes through the series combination of diode 208 and sense resistor 200. The voltage at the negative input of operational amplifier 170 is therefore proportional to the current through lamps 102.

However, if lamps 102 are not in place, there is no current through resistor 200, and thus no voltage on the input of the operational amplifier 170, which results in a decrease in the frequency of the inverter 100. The decrease in the frequency results in an increased voltage across resonant capacitor 122 which is coupled to primary winding 126. If the voltage across the capacitor is not limited, the ballast will fail.

The directing circuit formed by the bridge diode 206, the clamp winding 130, and diodes 208, 210 provide protection from this type of failure. By maintaining a zero current through the sense resistor 200, the output of the operational amplifier 170 maintains the inverter 100 at a low frequency. Operation of the inverter 100 at a low frequency results in the highest output voltage. With the output of the inverter 100 at its maximum output voltage, when the lamps 102 are inserted into the circuit, they will strike quickly.

The anode of the bridge diode 206 is connected between the cathode of diode 208 and sense resistor 200.

The voltage across output winding 128 also increases, based upon the turns ratio between the windings 128, 126, resulting in an increasing voltage across clamp winding 130. When the voltage across the clamp winding 130 exceeds the DC rail voltage, then bridge diode 206 will conduct, which clamps the winding to the DC rail voltage.

The output of inverter 100 is AC. Protection in a lamp out condition must be accomplished in both half-cycles of the AC output.

During the half-cycle when the output of the inverter is above ground, the positive current flows out of winding 130 to the DC rail, a current is establishing in primary winding 126, and flows through diode 208 to the anode of the diode bridge 206. Thus, there is no current that flows through sense resistor 200.

During the half-cycle when the output of the inverter is below ground; current flows through diode 210, the current is thus steered from the sense resistor 200 by the operation of diodes 208, 210 during lamp out conditions.

We claim:

1. A circuit for powering gas discharge lamps from a source of DC power comprising:

an inverter having an inverter input and an inverter output, the inverter input coupled to the DC power source, the inverter output producing AC power at an AC voltage at an inverter frequency;

an inverter control for controlling the power of the inverter output;

a clamp network connected to the inverter for limiting the voltage of the inverter output during a fault condition;

a dimming control for controlling the power output of the inverter;

a transformer having a primary winding and a secondary winding, the primary winding connected to the inverter output, the secondary winding coupled to the lamps, and arranged such that a lamp current flows through the lamps;

a sensor coupled to the primary winding for sensing the lamp current, and also coupled to the inverter control, such that the power of the inverter output is controlled by the lamp current; and a directing circuit for directing current in the clamp network away from the sensor.

2. The circuit of claim 1 where the clamp network includes a winding coupled to the transformer.

3. A circuit for powering gas discharge lamps from a source of DC power comprising:

an inverter having an inverter input and an inverter output, the inverter input coupled to the DC power source, the inverter output producing AC power at an AC voltage at an inverter frequency;

an inverter control for controlling the power of the inverter output;

a transformer having a primary winding and a secondary winding, the primary winding connected to the inverter output, the secondary winding coupled to the lamps, and arranged such that a lamp current flows through the lamps, the inverter output coupled to the lamps by way of a resonant circuit, the resonant circuit having a resonant frequency, and the power output of the inverter is controlled by varying the frequency of the voltage output of the inverter;

a sensor coupled to the primary winding for sensing the lamp current, and also coupled to the inverter control, such that the power of the inverter output is controlled by the lamp current;

a directing circuit for directing current in the clamp network away from the sensor, a clamp network for limiting the voltage of the inverter output to a clamp voltage during a fault condition; and a dimming control for controlling the inverter frequency.

4. The circuit of claim 3 where the clamp network includes a winding coupled to the transformer.

5. The circuit of claim 4 where the clamp network further includes a diode bridge, the diode bridge coupled to the clamp network, the diode bridge referenced to the DC source voltage.

6. A circuit for powering gas discharge lamps from a source of DC power comprising:

an inverter having an inverter input and an inverter output, the inverter input coupled to the DC power source, the inverter output producing AC power at an AC voltage at an inverter frequency;

an inverter control for controlling the power of the inverter output;

a clamp network for limiting the voltage of the inverter output during a fault condition;

a dimming control for controlling the power output of the inverter;

a directing circuit for directing current in the clamp network away from the sensor, a transformer having a primary winding and a secondary winding, the primary winding connected to the inverter output, the secondary winding coupled to the lamps, and arranged such that a lamp current flows through the lamps; and a sensor coupled to the primary winding for sensing the lamp current, and also coupled to the inverter control, such that the power of the inverter output is controlled by the lamp current.

7. The circuit of claim 6 where the clamp network includes a winding coupled to the transformer.

8. The circuit of claim 7 where the clamp network further includes a diode bridge, the diode bridge coupled to the clamp network, the diode bridge referenced to the DC source voltage.

9. The circuit of claim 8 further including a directing circuit for directing current in the clamp network away from the sensor.

10. The circuit of claim 9 where the directing circuit comprises a first diode in series with the sensor and a second diode in parallel with the series combination of the first diode and sensor, the polarities of the diodes arranged such that the clamp current is directed away from the sensor.

11. A circuit for powering gas discharge lamps from a source of DC power comprising:

an inverter having an inverter input and an inverter output, the inverter input coupled to the DC power source, the inverter output producing AC power at an AC voltage at an inverter frequency, the inverter output coupled to the lamps by way of a resonant circuit, the resonant circuit having a resonant frequency, and the power output of the inverter controlled by varying the frequency of the voltage output of the inverter, an inverter control for controlling the power of the inverter output;

a clamp network connected to the inverter for limiting the voltage of the inverter output during a fault condition;

a diode bridge coupled to the clamp network, the diode bridge referenced to the DC source voltage;

a dimming control for controlling the power output of the inverter;

a transformer having a primary winding and a secondary winding, the primary winding connected to the inverter output, the secondary winding coupled to the lamps, and arranged such that a lamp current flows through the lamps; and a sensor coupled to the primary winding for sensing the lamp current, and also coupled to the inverter control, such that the power of the inverter output is controlled by the lamp current.

12. The circuit of claim 11 further including a directing circuit for directing current in the clamp network away from the sensor.

13. The circuit of claim 12 where the directing circuit comprises a first diode in series with the sensor and a second diode in parallel with the series combination of the first diode and sensor, the polarities of the diodes arranged such that the clamp current is directed away from the sensor.

* * * * *